US006817736B1

(12) United States Patent
Porter

(10) Patent No.: US 6,817,736 B1
(45) Date of Patent: Nov. 16, 2004

(54) WINDOW FRAME FOR LIGHTS

(76) Inventor: Wardell Porter, 431 N. Leamington, Chicago, IL (US) 60644

( * ) Notice: Subject to any disclaimer, the term of this patent is extended or adjusted under 35 U.S.C. 154(b) by 0 days.

(21) Appl. No.: 10/184,852

(22) Filed: Jun. 28, 2002

(51) Int. Cl.[7] ..... F21V 21/00; F21V 21/08

(52) U.S. Cl. ..... 362/249; 362/252; 362/253; 362/145; 362/806; 52/173.1; 52/565.5; 52/565.8

(58) Field of Search ..... 49/465, 181, 449; 52/173.1, 656.2, 656.4, 656.5, 656.6, 656.8; 362/145, 249, 252, 253, 806; 40/714

(56) References Cited

U.S. PATENT DOCUMENTS 1,523,737 A * 1/1925 Willard
2,442,147 A * 5/1948 Recklitis
2,549,928 A * 4/1951 Reefe
3,025,389 A * 3/1962 Esch ..... 362/147
3,098,611 A * 7/1963 Connell ..... 40/714
3,275,818 A * 9/1966 Campbell ..... 362/249
3,319,032 A * 5/1967 Robison et al.
3,653,158 A * 4/1972 Aue et al.
3,943,355 A * 3/1976 Lundy
4,263,760 A * 4/1981 Gell
4,819,405 A * 4/1989 Jackson
4,821,158 A * 4/1989 Mitten
4,852,832 A * 8/1989 Delaney ..... 248/65
4,922,384 A * 5/1990 Torrence
4,995,181 A * 2/1991 Wolf
5,437,504 A * 8/1995 Halvatzis
5,700,083 A * 12/1997 Boechel ..... 362/249
5,791,762 A * 8/1998 Wroblewski
6,033,088 A * 3/2000 Contigiani
D426,327 S * 6/2000 Guzik
6,179,258 B1 * 1/2001 Dell'Aquila
6,186,644 B1 * 2/2001 Mosseau
2002/0133993 A1 * 9/2002 Mueller

* cited by examiner

*Primary Examiner*—Robert Canfield

(57) ABSTRACT

Window frames for lights are display holiday lights in a window. The window frame for lights installs without the use of any tools, and automatically adjusts to a variety of window widths. Spring-loaded adjustment tubes are present on either end of the frame, allowing the frame to frictionally engage with the sides of a window. Plastic end caps on the protruding end of the adjustment tubes prevent damage to the sides of the window and increase the frictional force. An outlet hole is provided to allow access to the extension outlet of the lights so that multiple strings of lights mounted in multiple window frames for lights can be electrically connected. A light channel and light hole present in the bottom member of the frame allow concealment of the cord for the lights.

11 Claims, 3 Drawing Sheets

WINDOW FRAME FOR LIGHTS

BACKGROUND OF THE INVENTION

1. Field of the Invention

The present invention relates to a window frame for lights for use in connection with holiday lights. The window frame for lights has particular utility in connection with displaying holiday lights in a window.

2. Description of the Prior Art

Window frames for lights are desirable for displaying holiday lights in a window. Traditional methods of displaying holiday lights in a window require the use of tape, tacks, nails, suction cups, or other fasteners which often damage the area surrounding the window or leave unsightly marks on the window glass. Furthermore, suction cups in particular are vulnerable to losing their grip on the window glass, resulting in the holiday lights falling off the window. These methods of installing holiday lights also require a significant amount of time. In contrast, the window frame for lights is simply adjusted to accommodate the window and positioned in place, resulting in rapid installation of the holiday lights without any damage to the area surrounding the window or to the window glass.

The use of ornament light frames is known in the prior art. For example, U.S. Pat. No. 5,580,160 to Schuler discloses an ornament light frame. However, the Schuler '160 patent does not have spring-loaded adapter tubes, and has further drawbacks of lacking an outlet hole.

U.S. Pat. No. Des. 426,327 to Guzik discloses a window light housing that supports holiday lights around the perimeter of a window. However, the Guzik '327 patent does not have spring-loaded adapter tubes, and additionally does not have an outlet hole.

Similarly, U.S. Pat. No. 4,995,181 to Wolf discloses a luminous display frame and kit that supports holiday lights around the perimeter of a window. However, the Wolf '181 patent does not have spring-loaded adapter tubes, and also does not have an outlet hole.

In addition, U.S. Pat. No. 5,791,762 to Wroblewski discloses a window display lighting system that supports holiday lights around the perimeter of a window. However, the Wroblewski '762 patent does not have a frame of one-piece construction, and also does not have an outlet hole Furthermore, U.S. Pat. No. 6,116,752 to Mayfield et al. discloses a holiday decoration with covered light string having projecting lights that includes first and second strands, at least one of which is a covered strand of lights. However, the Mayfield et al. '752 patent does not attached to a window without the use of suction cups, and further lacks a frame.

Lastly, U.S. Pat. No. 5,338,585 to Fraus et al. discloses an ornamental Christmas display that comprises a triangular backing sheet of pliant, easily rolled up material densely covered on one side with garland segments to create a wall hung Christmas tree display. However, the Fraus et al. '585 patent does not have spring-loaded adapter tubes, and has the additional deficiency of requiring that it be hung from a wall support.

While the above-described devices fulfill their respective, particular objectives and requirements, the aforementioned patents do not describe a window frame for lights that allows displaying holiday lights in a window. The Schuler '160 patent, the Guzik '327 patent, and the Wolf '181 patent make no provision for spring-loaded adapter tubes or an outlet hole. The Wroblewski '762 patent does not have a frame of one-piece construction and further lacks an outlet hole. The Mayfield et al. '752 patent requires the use of suction cups and does not have a frame. Finally, the Fraus et al. '585 patent does not have spring-loaded adapter tubes and requires that it be hung from a wall support.

Therefore, a need exists for a new and improved window frame for lights that can be used for displaying holiday lights in a window. In this regard, the present invention substantially fulfills this need. In this respect, the window frame for lights according to the present invention substantially departs from the conventional concepts and designs of the prior art, and in doing so provides an apparatus primarily developed for the purpose of displaying holiday lights in a window.

SUMMARY OF THE INVENTION

In view of the foregoing disadvantages inherent in the known types of ornament light frames now present in the prior art, the present invention provides an improved window frame for lights, and overcomes the above-mentioned disadvantages and drawbacks of the prior art. As such, the general purpose of the present invention, which will be described subsequently in greater detail, is to provide a new and improved window frame for lights which has all the advantages of the prior art mentioned heretofore and many novel features that result in a window frame for lights which is not anticipated, rendered obvious, suggested, or even implied by the prior art, either alone or in any combination thereof.

To attain this, the present invention essentially comprises a frame with a connected window attachment mechanism.

There has thus been outlined, rather broadly, the more important features of the invention in order that the detailed description thereof that follows may be better understood and in order that the present contribution to the art may be better appreciated.

The invention may also include the frame being square or rectangular in shape. There may be frame attachment mechanism holes present in each of the side members of the frame. The window attachment mechanism may take the form of a frame tube inserted through the frame attachment mechanism holes with a stop, compression spring, and adjustment tube in either end. End caps may be attached to the protruding end of each adjustment tube. The bottom member of the frame may have a hollow forming a light channel with an outlet hole at one end and a light hole piercing the top of the bottom member. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved window frame for lights that has all of the advantages of the prior art ornament light frames and none of the disadvantages.

It is another object of the present invention to provide a new and improved window frame for lights that may be easily and efficiently manufactured and marketed.

An even further object of the present invention is to provide a new and improved window frame for lights that has a low cost of manufacture with regard to both materials and labor, and which accordingly is then susceptible of low prices of sale to the consuming public, thereby making such window frame for lights economically available to the buying public.

Still another object of the present invention is to provide a new window frame for lights that provides in the apparatuses and methods of the prior art some of the advantages thereof, while simultaneously overcoming some of the disadvantages normally associated therewith.

Even still another object of the present invention is to provide a window frame for lights for displaying holiday lights in a window. This allows the user to install holiday lights in a window without damaging or dirtying the window glass or its surrounding area.

Still yet another object of the present invention is to provide a window frame for lights for displaying holiday lights in a window. This makes it possible to install holiday lights in a window without the use of tools.

An additional object of the present invention is to provide a window frame for lights for displaying holiday lights in a window. This allows the user to rapidly install holiday lights in a window.

A further object of the present invention is to provide a window frame for lights for displaying holiday lights in a window. This allows the user to electrically connect the holiday lights contained in multiple window frames for lights.

Lastly, it is an object of the present invention to provide a new and improved window frame for lights for displaying holiday lights in a window.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
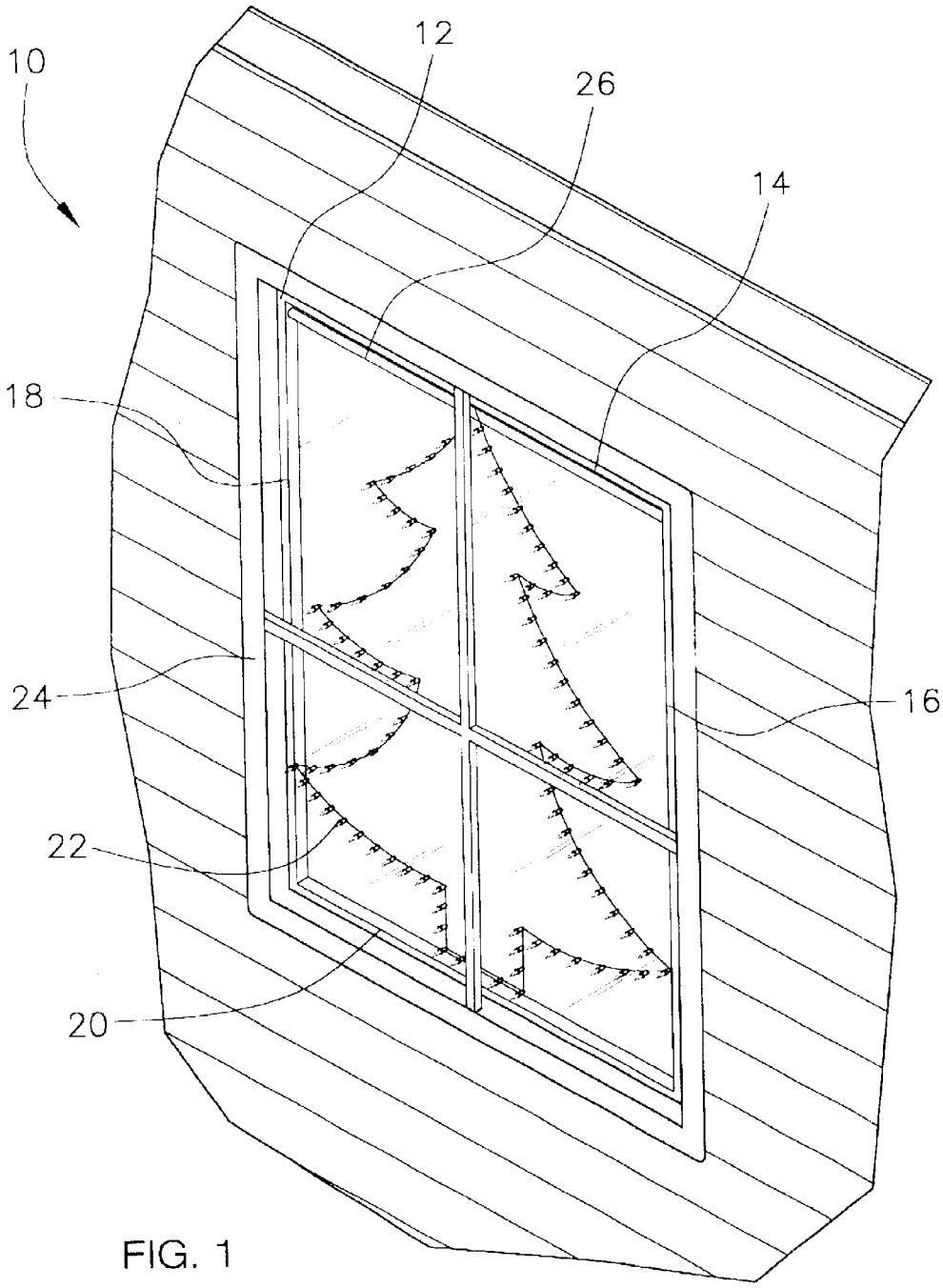
FIG. 1 is a front perspective view of the current embodiment of the window frame for lights constructed in accordance with the principles of the present invention.

Referring now to the drawings, and particularly to FIGS. 1–4, a current embodiment of the window frame for lights of the present invention is shown and generally designated by the reference numeral 10.

In FIG. 1, a new and improved window frame for lights 10 of the present invention for displaying holiday lights in a window is illustrated and will be described. More particularly, the window frame for lights 10 has a frame 12 inserted into a window 24. In the current embodiment, frame 12 is made of plastic and is rectangular in shape. Frame 12 has a top member 14 and a bottom member 20 connected by left side member 18 and right side member 16. Lights 22 are supported by frame 12. A frame tube 26, which assists in supporting frame 12 within window 24, is shown inserted into left side member 18 and right side member 16 in close proximity to top member 14. In the current embodiment, frame tube 26 is made of steel. Note that the lights 22 and window 24 are for illustrative purposes only and are not part of the current invention.

Figure 2:
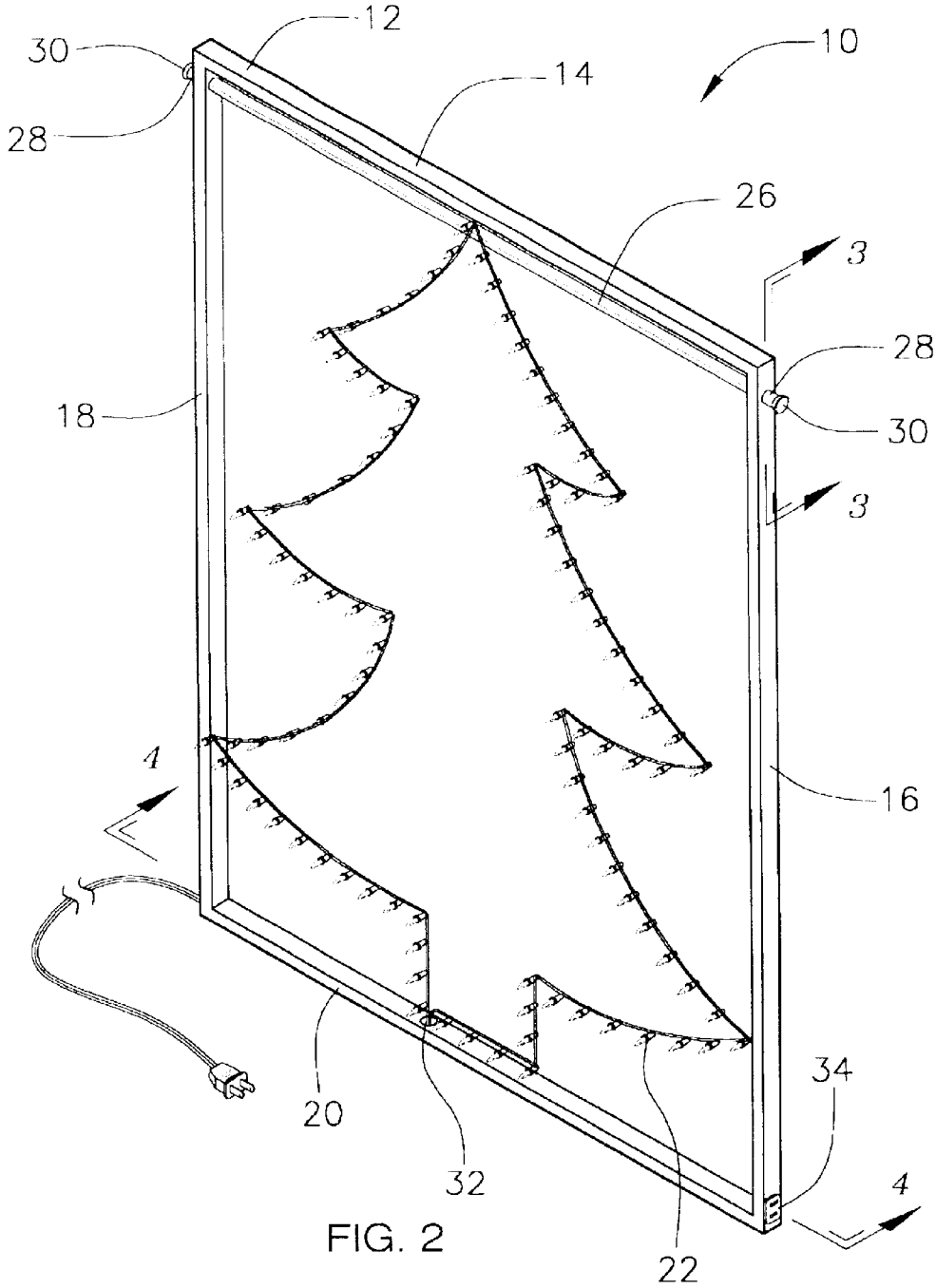
FIG. 2 is a front perspective view of the window frame for lights of the present invention.

Moving on to FIG. 2, a new and improved window frame for lights 10 of the present invention for displaying holiday lights in a window is illustrated and will be described. More particularly, the window frame for lights 10 has a frame 12 with a top member 14, right side member 16, left side member 18, and bottom member 20. Frame tube 26 is shown with either end inserted into left side member 18 and right side member 16. Inserted into either end of frame tube 26 are adjustment tubes 28 with end caps 30. Adjustment tubes 28 are made of steel, and end caps 30 are made of plastic, in the current embodiment. The end caps 30 protect the areas surrounding window 24 (not shown) from damage. Piercing the top of bottom member 20 is light hole 32. Lights 22 pass through light hole 32. Visible at one end of bottom member 20 is extension outlet 34 of lights 22. Accessibility to extension outlet 34 is provided in the window frame for lights 10 so that multiple window frames for lights 10 can have their lights 22 electrically connected together. Note that the lights 22 and extension outlet 34 are for illustrative purposes only and are not part of the current invention.

Figure 3:
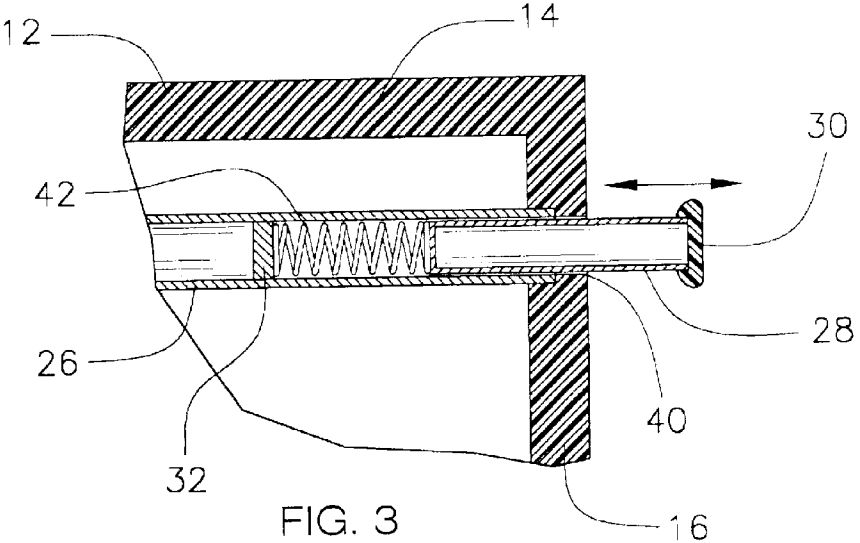
FIG. 3 is a side sectional view of the frame of the present invention.

Continuing with FIG. 3, a new and improved frame 12 of the present invention for displaying holiday lights in a window is illustrated and will be described. More particularly, the frame 12 has a top member 14 connected to right side member 16. A frame attachment mechanism hole 40 pierces right side member 16 in close proximity to top member 14. Frame tube 20 has one end inserted into the frame attachment mechanism hole 40. Inserted within the end of frame tube 20 is stop 32, compression spring 42, and adjustment tube 28 with end cap 30. In the current embodiment, stop 32 is made of steel and compression spring 42 is made of spring steel. In order to install the window frame for lights 10 in a window 24 (not shown), compression spring 42 is compressed between stop 32 and one end of adjustment tube 28. Compression spring 42 pushes against adjustment tube 28 and causes end cap 30 to frictionally engage with the area surrounding window 24. When both end caps 30 are frictionally engaged with the area surrounding window 24, the window frame for lights 10 is held in place. A variety of widths of window 24 can be accommodated because compression springs 42 can be compressed to varying degrees, thereby altering the width of the window frame for lights 10.

Figure 4:
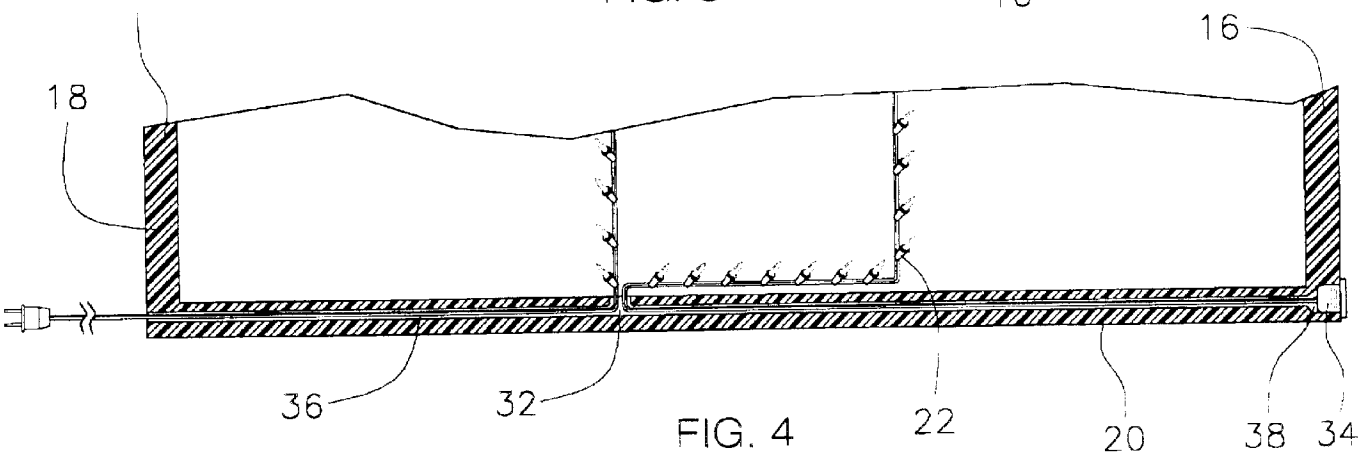
FIG. 4 is a side sectional view of the frame of the present invention.

Concluding with FIG. 4, a new and improved frame 12 of the present invention for displaying holiday lights in a window is illustrated and will be described. More particularly, the frame 12 has a left side member 18 and a right side member 16 connected to the opposing ends of bottom member 20. Bottom member 20 is hollow, forming a light channel 36 which allows lights 22 to pass-through bottom member 20. Light hole 32 is cut in the top of bottom member 20 to allow lights 22 to exit light channel 36 into the area enclosed by frame 12. At one end of bottom member 20 is outlet hole 38 which is adapted to fit the extension outlet 34 of lights 22. Note that the lights 22 and extension outlet 34 are for illustrative purposes only and are not part of the current invention.

While a current embodiment of the window frame for lights has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, wood, aluminum, titanium, or carbon fiber composite may be used instead of the plastic frame described. Also, the steel frame tube and adjustment tubes may also be made of plastic, wood, aluminum, titanium, or carbon fiber composite. And although a rectangular frame has been described, it should be appreciated that the frame could also be made in a variety of other shapes, including squares. Furthermore, a wide variety of non marking, nonskid materials may be used instead of the plastic end caps described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A window frame for lights comprising:

a frame having a top, opposing sides, and a bottom with said bottom having a top and opposing ends, wherein said frame is adapted to support a string of lights without enclosing any part of the socket portion of said string of lights; and a window attachment mechanism connected to said frame;

wherein said window attachment mechanism comprises:

a hollow frame tube with opposing ends;

a plurality of stops inserted into either end of said frame tube;

a plurality of compression springs having opposing ends with one end in contact with said stops; and a plurality of adjustment tubes having opposing ends inserted into either end of said frame tube with one end in contact with said compression springs.

2. The window frame for lights as defined in claim 1, wherein said frame tube is selected from the group consisting of plastic, wood, aluminum, titanium, steel, and carbon fiber composite.

3. The window frame for lights as defined in claim 1, wherein said stops are selected from the group consisting of plastic, wood, aluminum, titanium, steel, and carbon fiber composite.

4. The window frame for lights as defined in claim 1, wherein said adjustment tubes are selected from the group consisting of plastic, wood, aluminum, titanium, steel, and carbon fiber composite.

5. The window frame for lights as defined in claim 1, further comprising a plurality of end caps attached to said opposing ends of said adjustment tubes.

6. The window frame for lights as defined in claim 5, wherein said end caps are selected from the group consisting of plastic, rubber, and wood.

7. A window frame for lights comprising:

a top member having opposing ends, wherein said top member is adapted to support a string of lights without enclosing any part of the socket portion of said string of lights;

a left side member having opposing ends and a middle with one end attached to said end of said top member, wherein said left side member is adapted to support a string of lights without enclosing any part of the socket portion of said string of lights;

a right side member having opposing ends and a middle with one end attached to said opposing end of said top member, wherein said right side member is adapted to support a string of lights without enclosing any part of the socket portion of said string of lights;

a plurality of frame attachment mechanism holes wherein said middle of said left side member and said middle of said right side member comprise a hole therein to comprise said frame attachment mechanism holes;

a bottom member having opposing ends and a top with one end attached to said opposing end of said left side member and said opposing end attached to said opposing end of said right side member, wherein said bottom member is adapted to support a string of lights without enclosing any part of the socket portion of said string of lights; and a window attachment mechanism inserted through said frame attachment mechanism holes;

wherein said window attachment mechanism comprises:

a hollow frame tube with opposing ends;

a plurality of stops inserted into either end of said frame tube;

a plurality of compression springs having opposing ends with one end in contact with said stops;

a plurality of adjustment tubes having opposing ends inserted into either end of said frame tube with one end in contact with said compression springs; and a plurality of end caps attached to said opposing ends of said adjustment tubes.

8. The window frame for lights as defined in claim 7, wherein said end caps are selected from the group consisting of plastic, rubber, and wood.

9. A window frame for lights comprising:

a frame having a top, opposing sides, and a bottom with said bottom having a top and opposing ends, wherein said frame is adapted to support a string of lights in a pattern other than rectangular;

a hollow frame tube with opposing ends inserted through said opposing sides of said frame;

a plurality of stops inserted into either end of said frame tube;

a plurality of compression springs having opposing ends with one end in contact with said stops;

a plurality of adjustment tubes having opposing ends inserted into either end of said frame tube with one end in contact with said compression springs; and a plurality of end caps attached to said opposing ends of said adjustment tubes.

10. The window frame for lights as defined in claim 9, wherein said frame is generally square or rectangular in shape.

11. The window frame for lights as defined in claim 9, further comprising:

a light channel, wherein said bottom of said frame defines a hollow therein to comprise said light channel;

a light hole, wherein said top of said bottom of said frame defines a hole therein to comprise said light hole; and an outlet hole, wherein said end of said bottom of said frame defines a hole therein to comprise said outlet hole.

* * * * *